US009770730B2

(12) United States Patent
Stednitz

(10) Patent No.: US 9,770,730 B2
(45) Date of Patent: Sep. 26, 2017

(54) CLEANING APPARATUS

(71) Applicant: Strahman Valves, Inc., Bethlehem, PA (US)

(72) Inventor: Samuel Gregory Stednitz, St. Clair, PA (US)

(73) Assignee: Strahman Valves, Inc., Bethlehem, PA (US)

( * ) Notice: Subject to any disclaimer, the term of this patent is extended or adjusted under 35 U.S.C. 154(b) by 0 days.

(21) Appl. No.: 14/846,236

(22) Filed: Sep. 4, 2015

(65) Prior Publication Data

US 2016/0067748 A1 Mar. 10, 2016

Related U.S. Application Data

(60) Provisional application No. 62/045,852, filed on Sep. 4, 2014.

(51) Int. Cl.

| | |
|---|---|
| ***B05B 3/18*** | (2006.01) |
| ***B05B 9/00*** | (2006.01) |
| ***B05B 15/06*** | (2006.01) |
| ***B08B 3/02*** | (2006.01) |

(52) U.S. Cl.

CPC ..... *B05B 9/007* (2013.01); *B05B 3/18* (2013.01); *B05B 15/063* (2013.01); *B05B 15/064* (2013.01); *B08B 3/028* (2013.01)

(58) Field of Classification Search

CPC ... B05B 15/065; B05B 15/064; B05B 15/063; B05B 3/18; F16L 27/0845; B08B 3/024

USPC ..... 239/754, 280–281, 588; 285/147.1, 285/121.6; 401/139; 15/144.1; 16/900, 16/430

See application file for complete search history.

(56) References Cited

U.S. PATENT DOCUMENTS

| | | | | |
|---|---|---|---|---|
| 3,896,841 | A | 7/1975 | Bahlke | |
| 4,022,498 | A | 5/1977 | Jameson | |
| 4,095,746 | A * | 6/1978 | Anderberg | B05B 1/202 239/754 |
| 4,209,192 | A | 6/1980 | Knight | |
| 4,653,554 | A | 3/1987 | Von Meyerinck et al. | |
| 5,040,729 | A * | 8/1991 | Carrozza | B05B 15/066 239/201 |

(Continued)

FOREIGN PATENT DOCUMENTS

| | | |
|---|---|---|
| GB | 2256858 A | 12/1992 |
| WO | 0111282 A1 | 2/2001 |

OTHER PUBLICATIONS

Swivel Joints (Swing Joints) from CSE—Industrial Products Group, accessed from http://cse-ipg.com/joint.cfm on Jul. 1, 2014.

(Continued)

*Primary Examiner* — Arthur O Hall
*Assistant Examiner* — Tuongminh Pham
(74) *Attorney, Agent, or Firm* — Graham Curtin, P.A.

(57) ABSTRACT

A cleaning apparatus, including: a hollow handle with a first end and a second end; a spray manifold having an inlet and a plurality of outlets along a length of the spray manifold; and a plurality of wheels supporting the spray manifold; wherein the inlet of the spray manifold is connected to the first end of the handle via a swivel coupling assembly, such that the spray manifold is rotatable in two orthogonal directions relative to the handle; and wherein the second end of the handle is configured to receive a fluid.

12 Claims, 6 Drawing Sheets

(56) References Cited

U.S. PATENT DOCUMENTS

| | | | | |
|---|---|---|---|---|
| 5,707,014 | A * | 1/1998 | Chan | B60S 3/042 239/588 |
| 5,908,163 | A * | 6/1999 | Wells | B05B 1/3006 239/588 |
| 6,623,043 | B1 | 9/2003 | Pollack | |
| 6,655,613 | B1 | 12/2003 | Brown | |
| 7,063,281 | B2 * | 6/2006 | Schommer | B05B 7/0884 239/428.5 |
| 7,806,351 | B1 * | 10/2010 | Bakas | B05B 9/01 239/195 |
| 2002/0190145 | A1 * | 12/2002 | Sheppard, Jr. | B05B 9/007 239/754 |
| 2005/0127211 | A1 * | 6/2005 | Yeiser | B05B 1/205 239/587.1 |
| 2011/0247157 | A1 * | 10/2011 | Caillou | A47L 13/10 15/147.1 |

OTHER PUBLICATIONS

OPW Swivel Joint Styles and Shapes, Swivel Joints, accessed from http://www.swiveljoints.com/products on Jul. 1, 2014.

* cited by examiner

ALL STAINLESS WETTED CONSTRUCTION
ACETAL POLYMER GRIP AND WHEELS
WEIGHT 7.5 LBS.

SECTION C-C

CLEANING APPARATUS

CROSS-REFERENCE TO RELATED APPLICATIONS

This application claims the benefit of U.S. Provisional Patent Application No. 62/045,852, filed Sep. 4, 2014, the contents of which are incorporated by reference herein.

FIELD OF THE INVENTION

The invention generally relates to cleaning apparatuses. More particularly, the invention relates to cleaning apparatuses and systems that clean surfaces using pressurized water and/or air.

BACKGROUND

Floor sweeping devices that use pressurized water for surface cleaning have been used in many applications including: pharmaceutical, food processing, dairy, meat processing, supermarkets, and restaurants. However, existing cleaning devices are mostly designed for one particular application and for cleaning large open surface areas. Furthermore, many existing devices lack the maneuverability to go around tight corners, under a table or a cabinet.

Therefore, there is a need for a highly maneuverable surface cleaning apparatus or system for a wide array of applications.

SUMMARY

One embodiment of the invention provides a cleaning apparatus, including: a hollow handle with a first end and a second end; a spray manifold having an inlet and a plurality of outlets along a length of the spray manifold; and a plurality of wheels supporting the spray manifold; wherein the inlet of the spray manifold is connected to the first end of the handle via a swivel coupling assembly, such that the spray manifold is rotatable in two orthogonal directions relative to the handle; and wherein the second end of the handle is configured to receive a fluid.

DETAILED DESCRIPTION OF THE PREFERRED EMBODIMENTS

Figure 2:
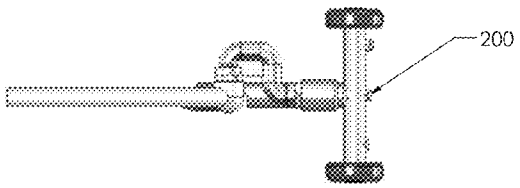
FIG. 2 illustrates a 3-tip spray cleaning apparatus according to an embodiment.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 1:
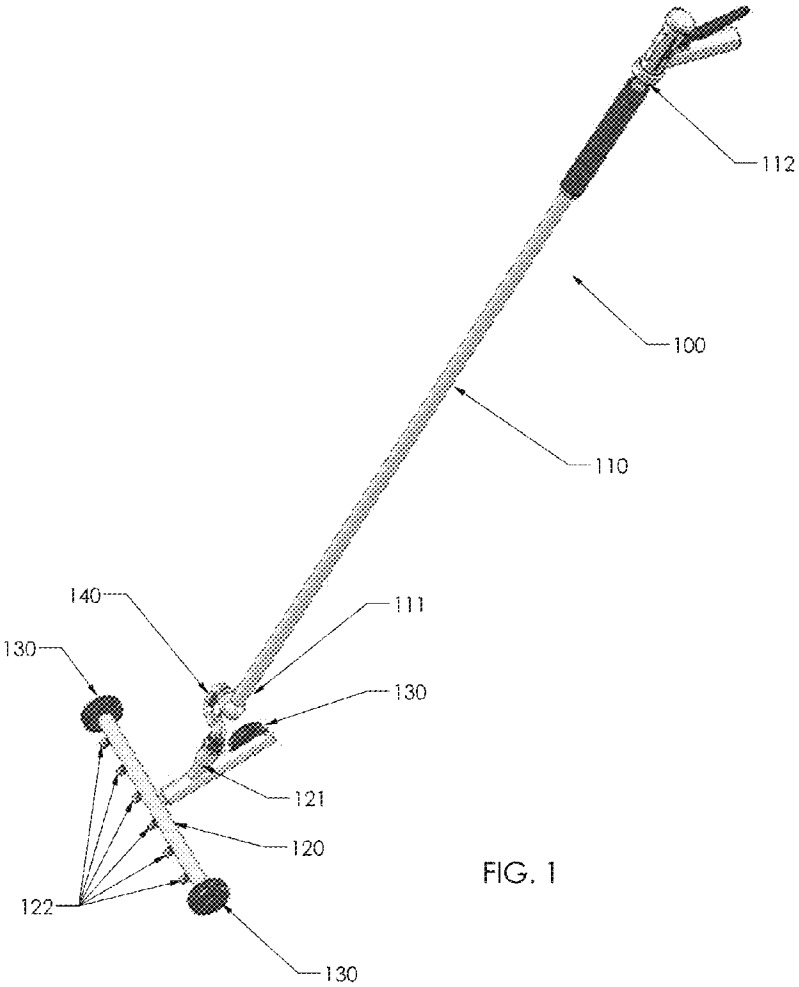
FIG. 1 illustrates a perspective view of a cleaning apparatus according to an embodiment.

FIG. 1 shows a cleaning apparatus 100 according to an embodiment of the invention. The cleaning apparatus 100 includes a hollow handle 110 with a first end 111 and a second end 112; a spray manifold 120 having an inlet 121 and a plurality of outlets 122 along a length of the spray manifold; and a plurality of wheels 130 supporting the spray manifold 120. The inlet 121 of the spray manifold is connected to the first end 111 of the handle via a swivel coupling assembly 140, such that the handle swings in two orthogonal directions relative to the spray manifold; and wherein the second end 112 of the handle 110 is configured to receive a fluid.

Figure 3:
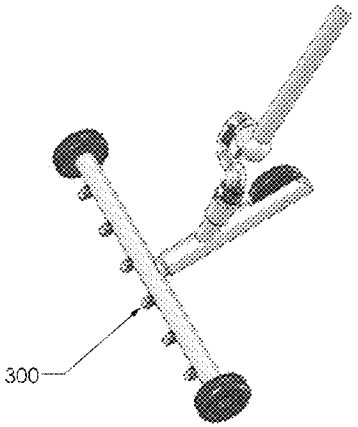
FIG. 3 illustrates a 6-tip spray cleaning apparatus according to another embodiment.

Some embodiments of the cleaning apparatus come in with three spray tips configuration 200 as shown in FIG. 2, or six spray tips configuration 300 as shown in FIG. 3. Although only 3-tip and 6-tip configurations are shown, it is contemplated that the cleaning apparatus can be configured to accommodate different number of outlets or tips for different cleaning applications. In an embodiment, these spray tips are all interchangeable for a range of flow rates and spray patterns.

Figure 4:
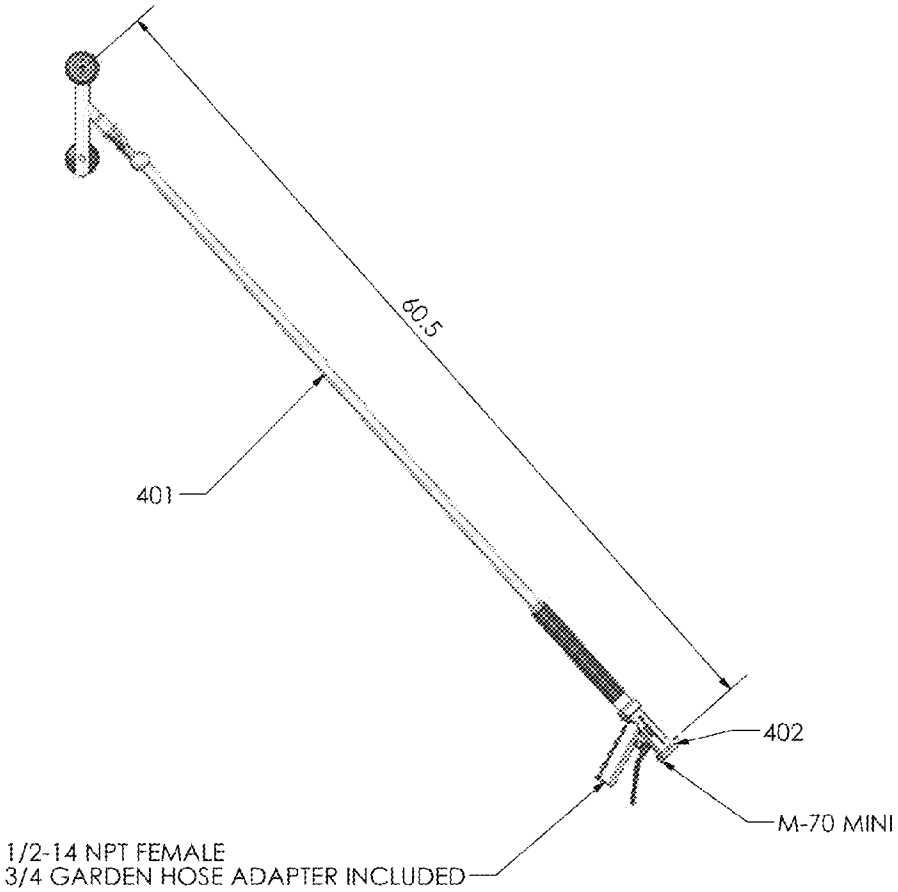
FIG. 4 illustrates a typical dimension of a cleaning apparatus according to an embodiment.
Figure 6:
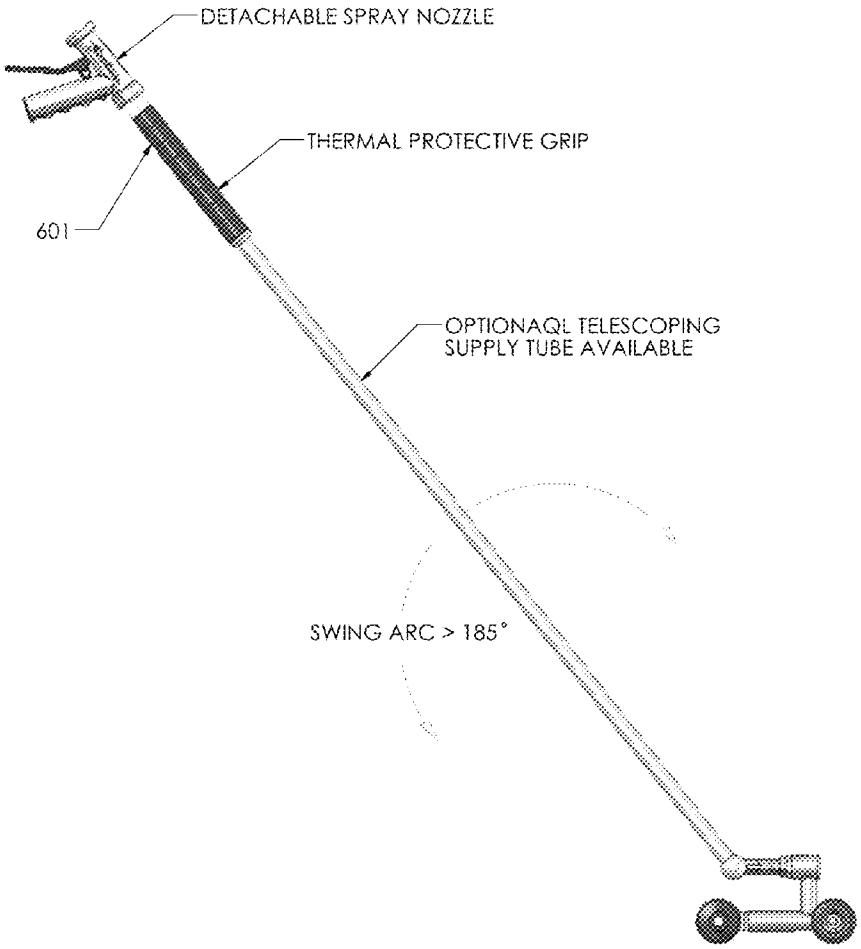
FIG. 6 illustrates a swing arc of a cleaning apparatus according to an embodiment.

FIG. 4 illustrates that an example length of the handle 401 is approximately 60.5 inches. However, it is contemplated that the handle can be of different lengths depending on the applications and users. As shown in FIG. 6, in one embodiment, the length of the handle is telescopically adjustable so that the cleaning apparatus can be used in a variety of applications and operated by different users. FIG. 4 also shows a detachable spray nozzle 402, e.g., Mini M-70 spray nozzle. FIG. 4 also shows a ½-14 NPT Female ¾ inch garden hose adapter. However, it is contemplated that other spray nozzles and/or adapter sizes may be used depending on the applications. There is a trigger that opens or closes a valve for supplying a fluid, e.g., water/air, to one end of the hollow handle 401 of the cleaning apparatus. The fluid enters in one end and comes out the other end of the hollow handle into the spray manifold via an inlet of the spray manifold. The spray manifold has a plurality of outlets for the fluid to come out. In one embodiment, each of the outlets includes a spray tip. In another embodiment, the spray tips are interchangeable so that different spray flows and/or spray patterns can be used depending on the application. For example, interchangeable tips ranging from 3 GPM to 7.5 GPM at 60 psi may be used.

Figure 5:
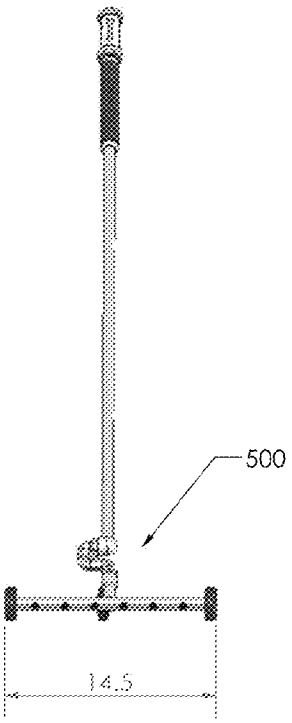
FIG. 5 illustrates another typical dimension of a cleaning apparatus according to an embodiment.
Figure 8:
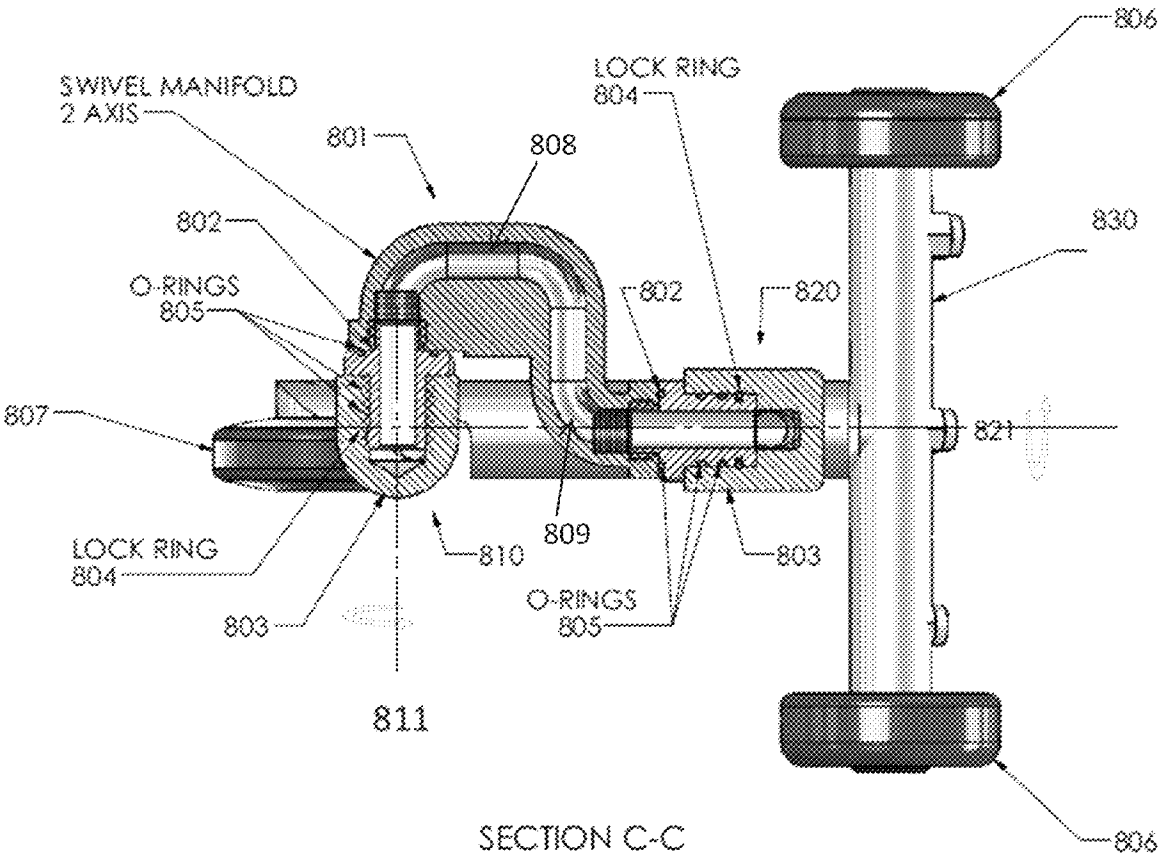
FIG. 8 illustrates a cross-sectional view of a swivel coupling assembly according to an embodiment.

FIG. 5 illustrates that an example length of the spray manifold 500 is approximately 14.5 inches. However, it is contemplated that the spray manifold can be made to different lengths depending on the applications and the physical environment, such as areas to be clean, sizes of passage way, obstacles, etc. As shown in FIG. 8, in one embodiment, the length of the spray manifold is telescopically adjustable so that the cleaning apparatus can be used in a variety of applications and environments. In one embodiment, the telescopically adjustable spray manifold includes an inner tube that slides inside an outer tube. In order that the outlets of inner tube are not be blocked by the outer tube wall and that the outlets of outer tube are not be blocked by the inner tube wall, the spacing of a number of outlets on the inner tube need to match the spacing of a number of outlets on the outer tube, such that the number of outlets on the inner tube will coincide with the corresponding plurality of outlets on the outer tube when the spray manifold is in a telescopic retracted state. Furthermore, when an outlet of the inner tube is coincide with an outlet of the outer tube, a spray tube can be inserted into both the outlets and thus securing the inner tube to the outer tube.

Figure 7:
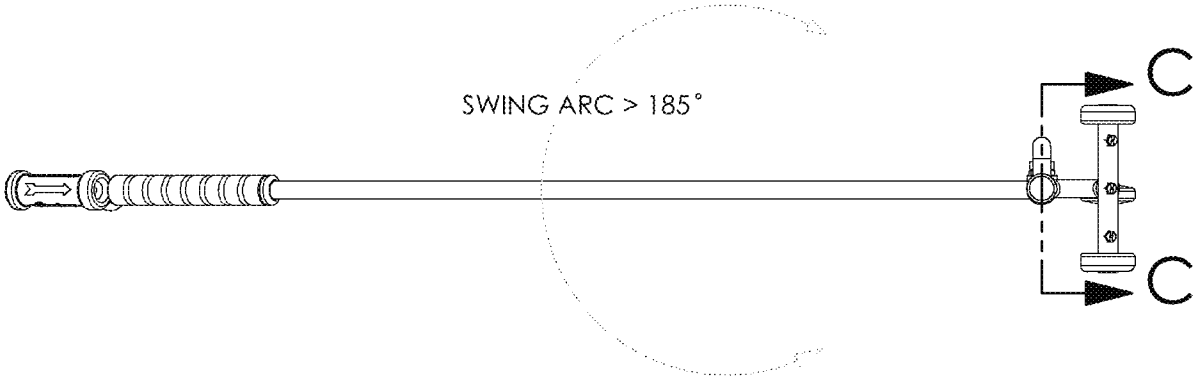
FIG. 7 illustrates another swing arc of a cleaning apparatus according to an embodiment.

FIG. 6 shows that one end of the hollow handle of the cleaning apparatus is provided with a thermal protective grip 601 so as to protect a user's hands when high temperature fluid is used, e.g., hot water or steam. FIG. 6 is a side view of the cleaning apparatus when viewing along the axis of rotation 811 of one swivel joint 810 shown in FIG. 8. FIG. 7 is a front view of the cleaning apparatus when viewing along the axis of rotation 821 of another swivel joint 820 shown in FIG. 8. As shown in FIGS. 6 and 7, the swing arc of the handle is greater than 185 degrees and up to full 360 degrees in two orthogonal directions when the swivel coupling assembly shown in FIG. 8 is used.

FIG. 8 shows a cross-section of a swivel coupling assembly according to an embodiment. As can be seen from FIG. 8, there is a curved pipe 801 which takes on a P-like shape. Note that in plumbing, it is commonly referred to as a P-trap. The curve pipe 801 shown in FIG. 8 can be roughly divided into a substantially U-shaped pipe portion and a straight pipe portion, a first end of the straight pipe portion being connected to a first end of the substantially U-shaped pipe portion at substantially 90 degrees. It is the addition of a 90 degree fitting on the outlet side of a U-bend, thereby creating a P-like shape. Note that the curved pipe 801 can be made by shaping a single continuous pipe into the P-like shape, or by joining a number of pipe sections and elbow pipes to form the desired P-like shape.

FIG. 8 shows the structure of the first and second swivel pipe joints 810, 820, in each of which a rotatable part 802 is held in place to a socket 803 by a lock ring 804, and a number of O-rings 805 provide the necessary seal. The two swivel pipe joints 810, 820 have axes of rotation 811, 821 that are orthogonal to each other. Therefore, fluid flowing through the hollow handle can enter the swivel coupling assembly from one end and leave from the other end to the inlet of the spray manifold.

FIG. 8 shows that the inlet of the spray manifold is connect to the first swivel pipe joint 820 which is also connected to one end of an elbow pipe portion 809 of the curve tube 801. The other end of the elbow pipe portion 809 is connected to one end of the substantially U-shaped pipe portion 808 of the curved tube 801. The other end of the substantially U-shaped pipe portion 808 is connected to the second swivel pipe joint 810 which is also connected to an end of the handle, so that the handle swings around the axis of rotation 811 of the second swivel pipe joint, rather than the handle spinning around such axis.

In another embodiment, the swivel coupling assembly utilizes an elbow pipe having a swivel joint at each of its end. The inlet of the spray manifold is connected to the swivel pipe joint at one end of the elbow pipe, and the end of the handle is connected to the swivel pipe joint at the other end of the elbow pipe. In this configuration, the axes of rotation of the swivel joints are orthogonal to each other. It is also contemplated that the swivel coupling assembly includes a ball joint which also provides two degrees of rotational freedom.

FIG. 8 also shows that the spray manifold 830 is supported by three wheels according to an embodiment. Two front wheels 806 are attached to both ends of the spray manifold and a third rear wheel 807 is attached to a platform extended from the center of the spray manifold. Note that other configurations having different number of wheels and/or positioning of the wheels are also contemplated. The wheels arrangements allow the cleaning device to move about the surface easily. The arrangement shown in FIG. 8 has advantages that the user has more leverage for operating and handling the cleaning device, it is more stable and it is easier to maneuver than existing cleaning devices.

Figure 9:
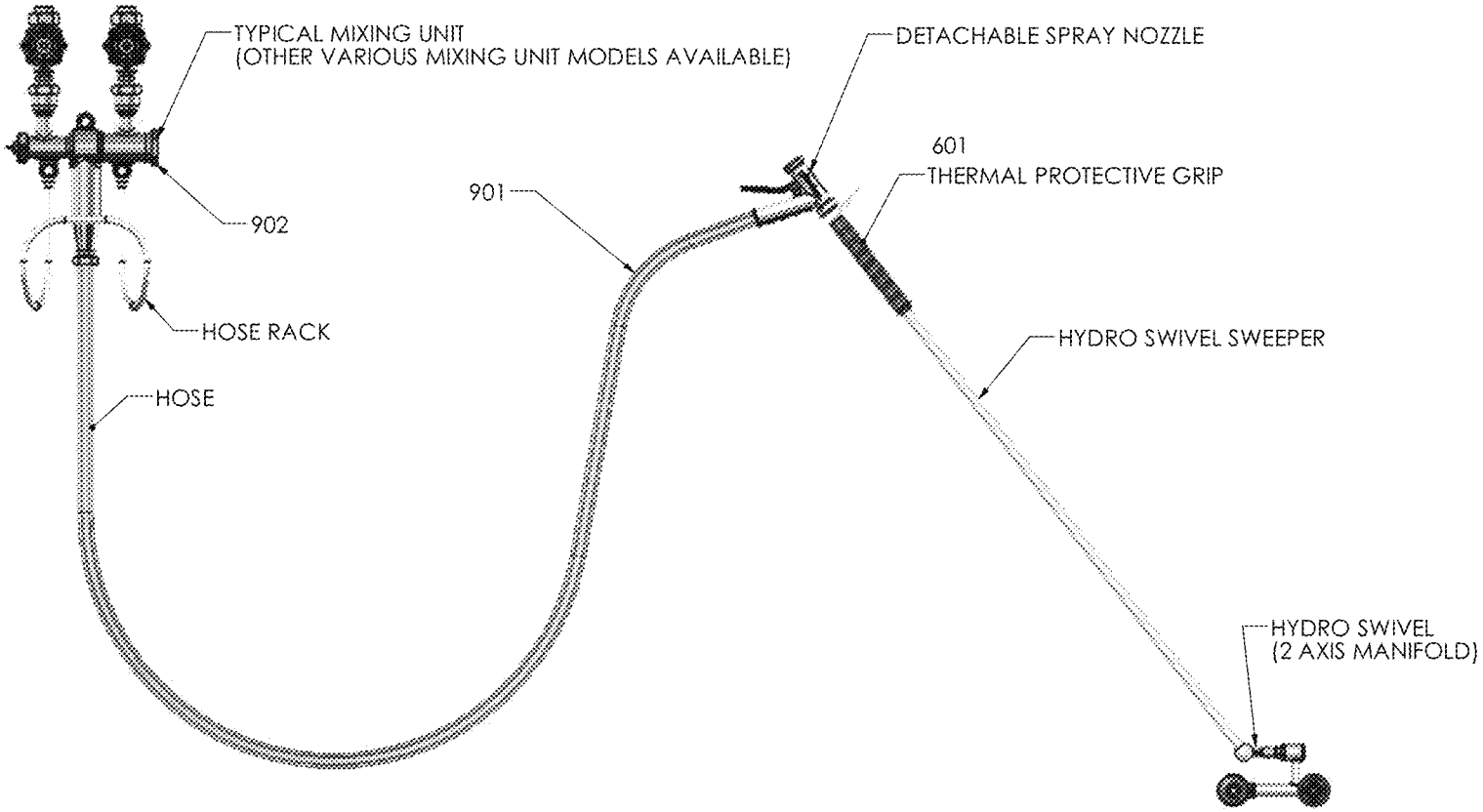
FIG. 9 illustrates a cleaning system according to an embodiment.

FIG. 9 shows a cleaning system according to an embodiment. The distal end of the hollow handle of the cleaning device discussed above is connected to one end of a hose 901, and the other end of the hose 901 is connected to a mixing unit 902. The mixing unit 902 mixes two different fluids in a desired proportion. For example, the mixing unit 902 may mix cold water and hot water to give a mixture of warm water. Furthermore, in one embodiment, the mixing control is integrated with the handle of the cleaning device, so that the user can conveniently adjust the desire proportion of the mixture.

A cleaning apparatus according to an embodiment of the invention is a multi-functioning cleaning tool for cleaning virtually any surface. In one embodiment, the cleaning apparatus features all stainless steel and acetal polymer construction, interchangeable tips with varying flow rates, a high-impact thermally protective cover, and comes with a mini M-70 spray nozzle. It is contemplated that other materials, such as alloys, aluminum, etc. may be used for some parts of the cleaning apparatus. Other types of tips, fixed or interchangeable; and types of spray nozzle are also contemplated depending on the specific application. Some applications of the cleaning apparatus include pharmaceutical, food processing, dairy, meat processing, supermarkets, and restaurants. In an embodiment, the cleaning apparatus features a fully articulated hydro-swivel joint which provides excellent maneuverability in and under hard-to reach places. In one embodiment, the cleaning apparatus uses high-velocity water at normal domestic supply pressures to effectively clean most surfaces with minimal impact. It cleans all of floor surfaces, even those under hard to reach places, with a spray pattern directed to the floor for deep cleaning of grout without over-spray to walls and without the damaging effects of other hi-pressure systems.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A cleaning apparatus, comprising:

a hollow handle with a first end and a second end;

a spray manifold having an inlet and a plurality of outlets along a length of the spray manifold; and a plurality of wheels supporting the spray manifold;

wherein the inlet of the spray manifold is connected to the first end of the handle via a swivel coupling assembly, such that the handle swings in two orthogonal directions relative to the spray manifold;

and wherein the second end of the handle is configured to receive a fluid;

wherein the swivel coupling assembly comprises:

a first swivel pipe joint;

a second swivel pipe joint; and a curved pipe comprising a substantially U-shaped pipe portion and a 90-degree elbow pipe portion;

wherein a first end of the 90-degree elbow pipe portion is connected to a first end of the substantially U-shaped pipe portion;

wherein the inlet of the spray manifold is connected to a second end of the 90-degree elbow pipe portion via the first swivel pipe joint;

wherein the first end of the handle is connected to a second end of the substantially U-shaped pipe portion via the second swivel pipe joint, an axis along the second end of the substantially U-shaped pipe portion being orthogonal to an axis along the second end of the 90-degree elbow pipe portion;

wherein a length of the spray manifold is telescopically adjustable;

wherein the telescopically adjustable spray manifold comprises an inner tube that slides inside an outer tube, wherein a spacing of a plurality of outlets on the inner tube matches a spacing of a plurality of outlets on the outer tube, such that the plurality of outlets on the inner tube coincide with the plurality of outlets on the outer tube respectively when the spray manifold is in a telescopic retracted state; and wherein the inner tube is locked in with the outer tube by a spray nozzle that is inserted into an outlet of the inner tube and into an outlet of the outer tube coincide with the outlet of the inner tube.

2. The cleaning apparatus of claim 1, wherein the second end of the handle is equipped with a hand grip.

3. The cleaning apparatus of claim 2, wherein the hand grip comprises a hose adapter.

4. The cleaning apparatus of claim 3, wherein the hose adaptor comprises a valve that controls a flow of fluid through the adapter.

5. The cleaning apparatus of claim 4, wherein the valve is operated by a trigger on the hand grip.

6. The cleaning apparatus of claim 2, wherein the hand grip comprises a thermal protective material.

7. The cleaning apparatus of claim 2, wherein hand grip comprises a detachable spray nozzle.

8. The cleaning apparatus of claim 1, wherein a length of the handle is telescopically adjustable.

9. The cleaning apparatus of claim 1, wherein each of the plurality of outlets comprises a spray nozzle.

10. The cleaning apparatus of claim 1, wherein the plurality of outlets are configured to accept interchangeable spray nozzles of different spray patterns or flow rates.

11. The cleaning apparatus of claim 1, wherein the spray manifold is supported by two front wheels and one rear wheel.

12. The cleaning apparatus of claim 1, further comprising a mixing unit for receiving two fluids from two sources, the mixing unit delivering the fluids in a desired proportion to the cleaning apparatus.

* * * * *